US005993084A

United States Patent [19]

de Ruyter et al.

[11] Patent Number: 5,993,084

[45] Date of Patent: Nov. 30, 1999

[54] APPARATUS AND METHOD FOR THE PROCESSING OF PHOTOGRAPHIC SHEET MATERIAL

[75] Inventors: Dirk de Ruyter, Deurne; Bart Verhoest, Niel, both of Belgium

[73] Assignee: Agfa-Gevaert N.V., Mortsel, Belgium

[21] Appl. No.: 09/195,808

[22] Filed: Nov. 19, 1998

[30] Foreign Application Priority Data

Nov. 25, 1997 [EP] European Pat. Off. ..... 97203691

[51] Int. Cl.[6] ..... G03D 3/02; G03D 3/06

[52] U.S. Cl. ..... 396/630; 396/624; 396/626; 396/631

[58] Field of Search ..... 396/620, 622, 396/624, 626, 628, 630, 631

[56] References Cited

U.S. PATENT DOCUMENTS

| | | | |
|---|---|---|---|
| 4,451,132 | 5/1984 | Kishimoto | 396/630 |
| 4,804,990 | 2/1989 | Jessop | 396/630 |
| 5,802,416 | 9/1998 | Earle et al. | 396/626 |

*Primary Examiner*—Alan A. Mathews
*Attorney, Agent, or Firm*—Baker & Botts, L.L.P.

[57] ABSTRACT

The apparatus comprises a developing station (10), a second treatment station (12), a third treatment station (14). A liquid connection (52) is provided between the third treatment station (14) and the second treatment station (12). In a cleaning mode, liquid is fed from the developing station (10) to the third treatment station (14) to assist in cleaning of the third and second treatment stations (12, 14). The apparatus can be cleaned in a particularly convenient and efficient method, enabling optimum use of cleaning liquids and enabling automation of the cleaning process.

10 Claims, 2 Drawing Sheets

APPARATUS AND METHOD FOR THE PROCESSING OF PHOTOGRAPHIC SHEET MATERIAL

FIELD OF THE INVENTION

This invention relates to an apparatus and method for the processing of photographic sheet material, in particular photographic sheet material, such as X-ray film, presensitised plates, graphic art film and paper, and offset plates. More particularly the invention relates to improvements in apparatus in which photographic material is transported through one or more treatment units.

BACKGROUND OF INVENTION

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

A typical apparatus comprises a developing station followed by second and third treatment stations, which may, for example, be a fixing station and a washing station. The apparatus may have a generally horizontal or vertical configuration.

From time to time it is necessary to clean the processing apparatus, in order to remove debris which may derive from the sheet material itself and deposits derived from the treatment liquids. The usual process for cleaning a processing apparatus, whether of the vertical or horizontal configuration, is to drain the treatment liquids and to flush the apparatus through with cleaning liquid. Water, optionally containing various additives and optionally at an elevated temperature, is the usual cleaning liquid.

For environmental reasons, there is a desire to reduce the use of all raw materials used in a processing machine, including water and this is particularly the case where the apparatus is being used in an area where there is a shortage of water.

European patent application EP-A-0 774 691 (Agfa-Gevaert NV) discloses a method of cleaning a photographic sheet material processing apparatus having a vertical configuration in which cleaning liquid passes by gravity from one cell to another.

Such a method is limited in its applicability to vertical apparatus and in any event is not optimally efficient in terms of total liquid usage.

OBJECTS OF INVENTION

It is an object of the present invention to provide a photographic sheet material processing apparatus which can be cleaned in a particularly convenient and efficient method, enabling optimum use of cleaning liquids.

SUMMARY OF THE INVENTION

According to the invention, there is provided an apparatus for the processing of photographic sheet material comprising a developing station, a second treatment station, a third treatment station and a liquid connection between the third treatment station and the second treatment station, characterised by means for feeding liquid from the developing station to the third treatment station to assist in cleaning of the third and second treatment stations.

The apparatus may comprise a first multi-position valve positioned in an outlet line from the developing station, so arranged that in a first selected position (a processing position) of the first valve liquid from the developing station is directed to waste while in a second selected position (a cleaning position) of the first valve liquid is fed from the developing station to the third treatment station.

Preferably, means are provided for feeding cleaning liquid to the developing station. A second multi-position valve may be positioned in a fresh water inlet line to another treatment station, so arranged that in a first position (a processing position) of the second valve fresh water is fed to the other of the treatment stations while in a second selected position (a cleaning position) of the second valve fresh water is directed to the developing station.

Preferably, coupling means are provided between the first valve and the second valve. This coupling may be provided by physical or electrical means, for example by the use of a computer operated control device. Such a control device may enable automation of the cleaning process.

The developing station and the other stations may each be comprised by a single cell or by multiples cells arranged in cascade.

One or more intermediate treatment stations may be provided between the developing station and the second treatment station and/or between the second treatment station and the third treatment station.

In one possible embodiment, the second treatment station is a fixing treatment station and the third treatment station is a washing treatment station. This embodiment is suitable for the processing of rapid access material and X-ray material.

The washing treatment station suitably comprises a plurality of washing cells arranged in cascade and the fixing treatment station preferably comprises a plurality of fixing cells arranged in cascade.

It is convenient for the development cell to be connected to a developer mixing vessel, to which fresh water and selectably either developer concentrate, in liquid or powder form, or supplementary cleaning agents such as silver solubilising agents when appropriate and surfactants may be fed.

It is also convenient for the fixing station to be connected to a fixer mixing vessel, to which a supply of fixer concentrate in liquid or powder form and used washing liquid from the washing station are fed. The use of used washing liquid to prepare the fixing solution, saves on the quantity of fresh water needed for processing.

In a processing mode, sheet material to be processed is passed along a sheet material path through the apparatus. Developer concentrate and fresh water are fed to the developer mixer and the developing liquid so formed is fed to the developing station. Fresh water is fed to the washing station. Fixer concentrate and used washing liquid from the washing station are fed to the fixer mixer and the fixing liquid so formed is fed to the fixing station. As processing continues, the developing liquid in station is refreshed by the periodic addition of fresh developing liquid from the developer mixer while the used developing liquid is discharged to waste through the first multi-position valve in its "processing" position. The washing liquid in the washing station is refreshed by the periodic addition of fresh water and the used washing liquid is pumped into the fixer mixer. The fixing liquid in the fixing station is refreshed by the periodic addition of fresh fixing liquid from the fixer mixer while used fixing liquid is discharged to waste.

In a cleaning mode, fresh water and supplementary cleaning agents are fed to the developer mixer to form a cleaning liquid which is fed to the developing station to clean the latter. The cleaning liquid is then pumped via the first multi-position valve in its "cleaning" position to the washing station to clean the latter. The cleaning liquid is then pumped from the washing station to the fixing station to clean the latter. In this way, the cleaning liquid used to clean the washing station and the fixing station is derived from the developing station. Used cleaning liquid is discharged from the fixing station. The same pumps as used in the processing mode can be used in the cleaning mode. Not only does this avoid the need to provide further pumps, but also the processing pumps are cleaned in a convenient manner.

In an alternative embodiment, the second treatment station is a washing station and the third treatment station is a finishing station. This alternative embodiment is suitable for the processing of LITHOSTAR (Trade Mark), materials.

In this embodiment, the developing station is connected to a developer mixing vessel for the supply of fresh water, and selectably either developer concentrate, in liquid or powder form or supplementary cleaning agents. Again, a pump and a two-way multi-position valve may be positioned in an outlet line from the developing station. In one selected position of this valve liquid from the developing station is directed to waste. In the other selected position of the valve liquid is fed from the developing station to the finishing station.

The finishing station is connected to a finishing liquid mixing vessel for the supply of fresh water and selectably either finishing liquid concentrate in liquid or powder form or cleaning liquid from the developing station. A liquid connection line including a pump is provided between the finishing station and the intermediate rinsing station. The intermediate rinsing station has a liquid outlet which includes a pump for pumping used intermediate rinse liquid to waste.

The washing station is connected to a washing liquid mixing vessel for the supply of fresh water and washing liquid additives such as biocides and pH control agents, in liquid or powder form. The washing station has a liquid outlet which includes a pump for pumping used intermediate rinse liquid to waste. A liquid connection line including a pump and a closeable valve provided between the intermediate rinsing station and the washing station.

In a processing mode, sheet material to be processed is passed along a sheet material path through the apparatus. Developer concentrate and fresh water are fed to the developer mixer and the developing liquid so formed is fed to the developing station. Finishing liquid concentrate and fresh water are fed to the finisher mixer and the finishing liquid so formed is fed to the finishing station. Used finishing solution is pumped from the finishing station to the intermediate rinsing station. Used intermediate rinsing liquid is discharged to waste. Washing liquid additives and fresh water are fed to the washing liquid mixer. Washing liquid from the washing liquid mixer is fed to the washing station. As processing continues, the developing liquid in the developing station is refreshed by the periodic addition of fresh developing liquid from the developer mixer and the discharge of used developing liquid through the first multi-position valve in its "processing" position. The finishing liquid in the finishing station is refreshed by the periodic addition of fresh finishing liquid from the finisher mixer and the used finishing liquid is pumped into the intermediate rinsing station. The washing liquid in the washing station is refreshed by the periodic addition of fresh washing liquid from the washing liquid mixer and the discharge of used washing liquid to waste.

In a cleaning mode, fresh water and supplementary cleaning agents are fed to the developer mixer to form fresh cleaning liquid. The fresh cleaning liquid is fed to the developing station to clean the latter. The cleaning liquid is then pumped via the first multi-position valve in its "cleaning" position, to the finishing station to clean the latter. The cleaning liquid is then pumped from the finishing station to the intermediate rinsing station to clean the latter. The cleaning liquid is then pumped the intermediate rinsing station to the washing station to clean the latter. In this way, the cleaning liquid used to clean the finishing station, the intermediate rinsing station and the washing station is derived from the developing station. Used cleaning liquid is discharged from the washing station to waste.

According to a second aspect of the invention, there is provided a method of cleaning an apparatus for the processing of photographic sheet material comprising a developing station, a second treatment station and a third treatment station, the method comprising adding cleaning liquid to the third treatment station and allowing the cleaning liquid to pass from the third treatment station to the second treatment station, characterised by deriving the cleaning liquid at least in part from the developing station.

DETAILED DESCRIPTION OF THE INVENTION

Figure 1:
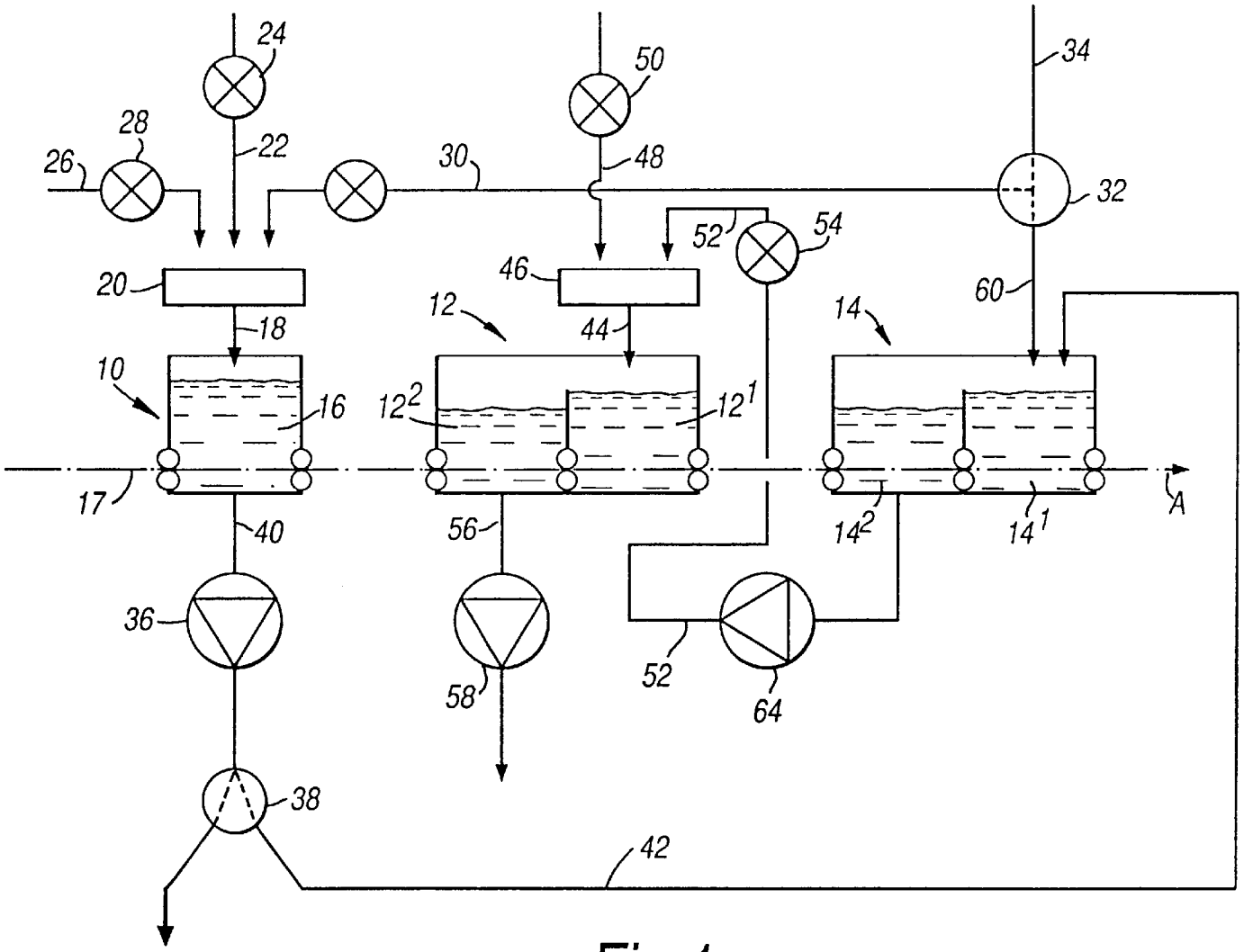
Figure 2:
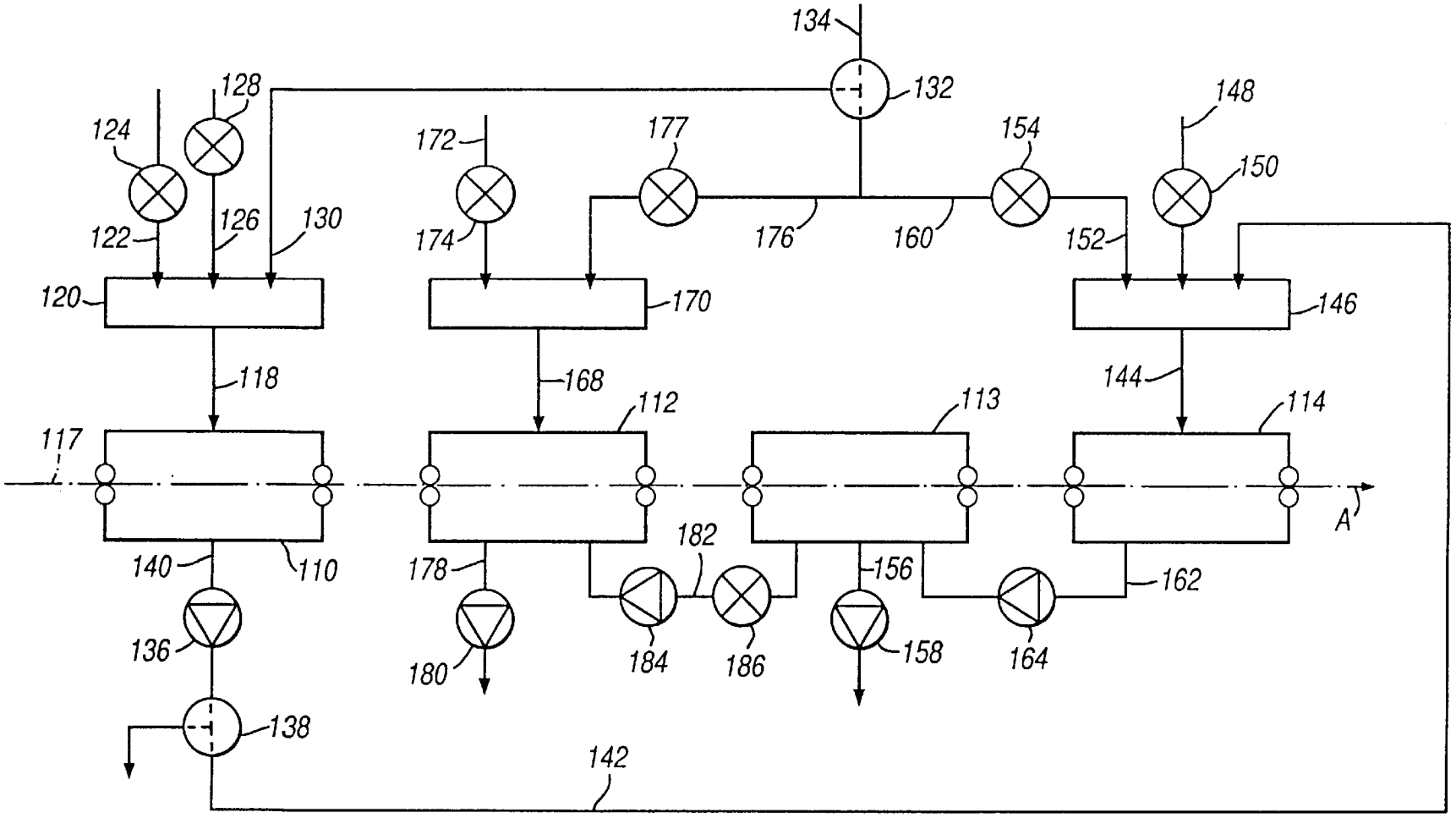

The invention will be described by the following illustrative embodiments with reference to the accompanying drawings without the intention to limit the invention thereto, and in which:

FIG. 1 is a schematic representation of an apparatus according to a first embodiment of the present invention; and FIG. 2 is a schematic representation of an apparatus according to a second embodiment of the present invention.

In the embodiment shown in FIG. 1, which is particularly suitable for the processing of rapid access film and X-ray material, the apparatus comprises a developing station 10, a fixing station 12 and a washing station 14.

The developing station 10 comprises a single developing cell 16 which has an inlet 18 connected to a developer mixing vessel 20. A line 22 including a closable valve 24 opens into the mixing vessel 20 for the supply of developer concentrate, in liquid or powder form. A line 26 including a closable valve 28 opens into the mixing vessel 20 for the supply of supplementary cleaning agents. A line 30 including a valve 32 also opens into the mixing vessel 20 for the supply of fresh water from a line 34.

A pump 36 and a two-way multi-position valve 38 are positioned in an outlet line 40 from the developing station 10. In one selected position of the valve 38 liquid from the developing station 10 is directed to waste. In the other selected position of the valve 38 liquid is fed from the developing station 10 via line 42 to the washing station 14.

The fixing station 12 comprises two fixing cells $\mathbf{12}^1$, $\mathbf{12}^2$ arranged in cascade. The downstream fixing station cell $\mathbf{12}^1$ has an inlet 44 connected to a fixer mixing vessel 46. A line 48 including a closable valve 50 opens into the mixing vessel 46 for the supply of fixer concentrate in liquid or powder form. A line 52 including a closable valve 54 also opens into the mixing vessel 46 for the supply of used washing liquid from the washing station 14. The upstream fixing station cell $12^2$ has a liquid outlet 56 which includes a pump 58 for pumping used fixer to waste. An overflow cascade configuration is shown, but an active cascade with a pump provided between the two fixing cells $12^1$, $12^2$ is also possible. An active fixing cascade has the further advantage of enabling the fixing cell $12^2$ to be emptied before cleaning and enabling a smaller volume of cleaning liquid to be used.

The washing station 14 comprises two washing cells $14^1$, $14^2$ arranged in cascade. A line 60 from the second multi-position valve 32 opens into the downstream washing station cell $14^1$. An overflow cascade configuration is shown, but an active cascade with a pump provided between the two washing cells $14^1$, $14^2$ is also possible. An active washing cascade has the further advantage of enabling the washing cell $14^2$ to be emptied before cleaning and enabling a smaller volume of cleaning liquid to be used.

The liquid connection line 52 including a pump 64 is provided between the upstream washing station cell $14^2$ and the downstream fixing station cell $12^1$.

A computer operated control device (not shown) controls the sequence of operation of the closable valves 24, 28, 50 and 54, the multi-position valves 32 and 38, and the pumps 36, 58 and 64. The control device enables automation of the cleaning process.

The apparatus is operated as follows.

In a processing mode, sheet material to be processed is passed along a sheet material path 17 through the apparatus in the direction of the arrow A. Developer concentrate and fresh water are fed to the mixer 20. Developing liquid from the mixer 20 is fed to the developing station 10. Fresh water is fed to the downstream washing station cell $14^1$ and overflows into the upstream washing station cell $14^2$. Fixer concentrate and used washing liquid from the washing station 14 are fed to the mixer 46. Fixing liquid from the mixer 46 is fed to the downstream fixing station cell $12^1$ and overflows into the upstream fixing station cell $12^2$. As processing continues, the developing liquid in station 10 is refreshed by the periodic addition of fresh developing liquid from the mixer 20 and the discharge of used developing liquid through the valve 38, in its "processing" position. The washing liquid in station 14 is refreshed by the periodic addition of fresh water and the used washing liquid is pumped by pump 64 via line 52 into the mixer 46. The fixing liquid in station 12 is refreshed by the periodic addition of fresh fixing liquid from the mixer 46 and the discharge of used fixing liquid through line 56.

In a cleaning mode, fresh water and optionally supplementary cleaning agents are fed to the mixer 20 to form a cleaning liquid. The cleaning liquid is fed to the developing station 10 to clean the latter. The cleaning liquid is then pumped by pump 36 via valve 38 in its "cleaning" position, via line 42 to the washing station 14 to clean the latter. The cleaning liquid is then pumped by the pump 64 via line 52 from the washing station 14 to the fixing station 12 to clean the latter. The cleaning liquid used to clean the washing station 14 and the fixing station 12 is therefore derived from the developing station 10. Used cleaning liquid is discharged from the fixing station 12 by pump 58 via line 56. The cleaning mode thus makes use of the hydraulics used during processing.

In the embodiment shown in FIG. 2, which is particularly suitable for the processing of LITHOSTAR (Trade Mark) aluminium printing plates, the apparatus comprises a developing station 110, a washing station 112, an intermediate rinsing station 113 and a finishing station 114.

The developing station 110 has an inlet 118 connected to a developer mixing vessel 120. A line 122 including a closable valve 124 opens into the mixing vessel 120 for the supply of developer concentrate, in liquid or powder form. A line 126 including a closable valve 128 opens into the mixing vessel 120 for the supply of supplementary cleaning agents. A line 130 leading from a valve 132 also opens into the mixing vessel 120 for the supply of fresh water from a line 134.

A pump 136 and a two-way multi-position valve 138 are positioned in an outlet line 140 from the developing station 110. In one selected position of the valve 138 liquid from the developing station 110 is directed to waste. In the other selected position of the valve 138 liquid is fed from the developing station 110 via line 142 to the finishing station 114.

The finishing station 114 has an inlet 144 connected to a finishing liquid mixing vessel 146. A line 148 including a closable valve 150 opens into the mixing vessel 146 for the supply of finishing liquid concentrate in liquid or powder form. A line 152 including a closable valve 154 also opens into the mixing vessel 146 for the supply of fresh water from the line 134 via line 160 and the multi-position valve 132. A liquid connection line 162 including a pump 164 is provided between the finishing station 114 and the rinsing station 113.

The rinsing station 113 has a liquid outlet 156 which includes a pump 158 for pumping used rinse liquid to waste.

The washing station 112 has an inlet 168 connected to a washing liquid mixing vessel 170. A line 172 including a closable valve 174 opens into the mixing vessel 170 for the supply of washing liquid additives, in liquid or powder form. A line 176 including a closable valve 177 opens into the mixing vessel 170 from the multi-position valve 132 for the supply of fresh water from the line 134. The washing station 113 has a liquid outlet 178 which includes a pump 180 for pumping used rinse liquid to waste. A liquid connection line 182 including a pump 184 and a closeable valve 186 is provided between the rinsing station 113 and the washing station 112.

A computer operated control device (not shown) controls the sequence of operation of the closeable valves 124, 128, 150, 154, 174, 177 and 186, the multi-position valves 132 and 138, and the pumps 136, 158, 164 and 184.

The apparatus shown in FIG. 2 is operated as follows.

In a processing mode, sheet material to be processed is passed along a sheet material path 117 through the apparatus in the direction of the arrow A. Developer concentrate and fresh water are fed to the mixer 120. Alternatively, ready mixed developer liquid is fed to the mixer 120. Developing liquid from the mixer 120 is fed to the developing station 110. Finishing liquid concentrate and fresh water are fed to the mixer 146. Finishing liquid from the mixer 146 is fed to the finishing station 114. Used finishing solution is pumped by the pump 164 via the line 162 from the finishing station to the rinsing station 113. Used rinsing liquid is discharged to waste by pump 158 via line 156. Closeable valve 186 remains closed. Washing liquid additives and fresh water are fed to the mixer 170. Washing liquid from the mixer 170 is fed to the washing station 112. As processing continues, the developing liquid in station 110 is refreshed by the periodic addition of fresh developing liquid from the mixer 120 and the discharge of used developing liquid through the valve 138, in its "processing" position. The finishing liquid in station 114 is refreshed by the periodic addition of fresh water and the used finishing liquid is pumped by pump 164 via line 162 into the rinsing station 113. The washing liquid in washing station 112 is refreshed by the periodic addition of fresh washing liquid from the mixer 170 and the discharge of used washing liquid by pump 178 through line 180.

In a cleaning mode, fresh water and supplementary cleaning agents are fed to the mixer 120 to form a cleaning liquid. The cleaning liquid is fed to the developing station 110 to clean the latter. The cleaning liquid is then pumped by pump 136 via valve 138 in its "cleaning" position, via line $14^2$ to the finishing station 114 to clean the latter. The cleaning liquid is then pumped by the pump 164 via line 162 from the finishing station 114 to the rinsing station 113 to clean the latter. The cleaning liquid is then pumped by the pump 184 via line 182 from the rinsing station 114 to the washing station 112 to clean the latter. The cleaning liquid used to clean the finishing station 114, the rinsing station 113 and the washing station 112 is therefore derived from the developing station 110. Used cleaning liquid is discharged from the washing station 112 by pump 180 via line 178. The cleaning mode thus makes use of the hydraulics used during processing.

We claim:

1. An apparatus for the processing of photographic sheet material comprising a developing station (10, 110), a second treatment station (12, 112), a third treatment station (14, 114) and a liquid connection (52, 162) between said third treatment station (14, 114) and said second treatment station (12, 112), characterised by means (42, 142) for feeding liquid from said developing station (10, 110) to said third treatment station (14, 114).

2. An apparatus according to claim 1, comprising a first multi-position valve (38, 138) positioned in an outlet line (40, 140) from said developing station (10, 110), so arranged that in a first selected position of said first valve (38, 138) liquid is fed from said developing station (10, 110) to said third treatment station (14, 114) while in a second selected position of said first valve (38, 138) liquid from said developing station (10, 110) is directed to waste.

3. An apparatus according to claim 1, further comprising means (30, 130) for feeding cleaning liquid to said developing station (10, 110).

4. An apparatus according to claim 3, comprising a second multi-position valve (32, 132) positioned in a fresh water inlet line (34, 134) to said third treatment station (14, 114), so arranged that in a first selected position of said second valve (32, 132) fresh water is directed to said developing station (10, 110), while in a second position of said second valve (32, 132) fresh water is fed to another of said treatment stations (14, 114).

5. An apparatus according to claims 1, comprising a first multi-position valve (38, 138) positioned in an outlet line (40, 140) from said developing station (10, 110), so arranged that in a first selected position of said first valve (38, 138) liquid is fed from said developing station (10, 110) to said third treatment station (14, 114) while in a second selected position of said first valve (38, 138) liquid from said developing station (10, 110) is directed to waste, a second multi-position valve (32, 132) positioned in a fresh water inlet line (34, 134) to said third treatment station (14, 114), so arranged that in a first selected position of said second valve (32, 132) fresh water is directed to said developing station (10, 110), while in a second position of said second valve (32, 132) fresh water is fed to another of said treatment stations (14, 114) and further comprising coupling means (66, 166) between said first valve (38, 138) and said second valve (32, 132).

6. An apparatus according to claim 1, wherein said second treatment station (12) is a fixing treatment station and said third treatment station (14) is a washing treatment station.

7. An apparatus according to claim 1, wherein said second treatment station is a washing treatment station (112) and said third treatment station is a finishing treatment station (114).

8. A method of cleaning an apparatus for the processing of photographic sheet material comprising a developing station (10, 110), a second treatment station (12, 112) and a third treatment station (14, 114), the method comprising adding cleaning liquid to said third treatment station (14, 114) and allowing said cleaning liquid to pass from said third treatment station (14, 114) to said second treatment station (12, 112), characterised by deriving said cleaning liquid at least in part from said developing station (10, 110).

9. A method according to claim 8, further comprising feeding fresh cleaning liquid to said developing station (10, 110).

10. A method according to claim 8, further comprising discharging waste cleaning liquid from said second treatment station (12, 112).

* * * * *